United States Patent [19]

McWilliams

[11] 4,327,280

[45] Apr. 27, 1982

[54] SMOOTH TOP COOKERS

[75] Inventor: Joseph A. McWilliams, Droitwich, England

[73] Assignee: Micropore International Limited, Droitwich, England

[21] Appl. No.: 118,951

[22] Filed: Feb. 6, 1980

[51] Int. Cl.[3] ..... H05B 3/76

[52] U.S. Cl. ..... 219/464; 219/462; 219/461; 219/449; 219/354

[58] Field of Search ..... 219/443, 445, 446, 449, 219/450, 452, 457–459, 460–467, 354, 411, 405

[56] References Cited

U.S. PATENT DOCUMENTS

| | | | |
|---|---|---|---|
| 1,049,488 | 1/1913 | Hughes et al. | 219/446 |
| 1,062,299 | 5/1913 | Pfanstiehl | 219/446 |
| 1,346,793 | 7/1920 | Bunnel et al. | 219/446 |
| 1,384,660 | 7/1921 | Gorritzen | 219/446 |
| 2,007,876 | 7/1935 | Sauvage | 219/446 |
| 2,150,492 | 3/1939 | Cory | 219/445 |
| 2,450,399 | 9/1948 | Scheidler | 219/446 |
| 2,900,480 | 8/1959 | Jordan | 219/466 |
| 3,710,076 | 1/1973 | Frazier | 219/464 |
| 4,158,127 | 6/1979 | Husslein | 219/466 |

FOREIGN PATENT DOCUMENTS

| | | | |
|---|---|---|---|
| 2500586 | 7/1976 | Fed. Rep. of Germany | 219/464 |
| 2551137 | 5/1977 | Fed. Rep. of Germany | 219/464 |
| 876981 | 11/1942 | France | 219/466 |
| 1530669 | 6/1968 | France | 219/443 |
| 1935572 | 1/1937 | Switzerland | 219/446 |
| 12984 | 9/1916 | United Kingdom | 219/466 |
| 428400 | 5/1935 | United Kingdom | 219/466 |
| 583201 | 12/1946 | United Kingdom | 219/464 |

*Primary Examiner*—B. A. Reynolds
*Assistant Examiner*—Bernard Roskoski
*Attorney, Agent, or Firm*—Pollock, Vande Sande & Priddy

[57] ABSTRACT

A radiant heater for use in "smooth top" cookers of the type in which a smooth top normally of glass ceramic overlays one or more generally circular electric heater elements supported on a layer of thermal and electrical insulating material such that the element is spaced from the top.

The radiant heater comprises at least two heater elements (10 and 12) supported on a base of electrical and thermal insulating material (4) at least one of which elements is energizable independently; and a peripheral wall (8) of thermal insulating material surrounding the elements.

The radiant heater of the invention is used in "smooth top" cookers and is covered by a top which is transparent and substantially non-absorptive to radiant cooking heat so that only the areas of the top which are exposed to the element will be heated. Preferably, the utensil being heated should have a base equal to the heated or exposed area of the top for maximum efficiency.

13 Claims, 4 Drawing Figures

SMOOTH TOP COOKERS

BACKGROUND OF THE INVENTION

This invention relates particularly to the so-called "smooth top" cookers of the type in which a smooth top normally of glass ceramic overlays one or more generally circular electric heater elements supported on a layer of thermal and electrical insulating material such that the element is spaced from the top. In use, a utensil placed on the top over an element is heated by the transmission of heat from an element to and through the top by air convection and infra red radiation. Such elements are referred to herein as "radiant heaters". The insulating material substantially prevents heat being transmitted away from the element except towards the top and as the preferred materials for the top are essentially thermally non-conductive, only areas of the top which are "exposed" to the element will be heated. In order to prevent heat being transmitted to parts of the top not covered by a utensil placed thereon, a peripheral wall of insulating material is also normally provided around the coil.

While the arrangement described above has been very successful, its best use efficiency is limited to use with utensils having bases of area substantially equal to that of the heater or "exposed" area of the top. Where the areas are not equal, either the heating of the utensil is non-uniform, or local areas of the top are exposed which is wasteful of heat.

SUMMARY OF THE INVENTION

The present invention is directed primarily at the problem of adapting radiant heaters to the different sizes and shapes of cooking utensils which are in popular use. In one broad aspect, the invention contemplates non-circular heaters which are suited to utensils having non-circular bases such as oval casseroles which are currently popular. In another aspect, heaters of the invention comprise two or more heater coils of which at least one may be energised independently of the other. For example, the combination of an independent circular coil and an adjacent part-circular coil enables the heater to be used for circular utensils, over the circular coil, and for oval utensils over both coils. Similarly, a central primary coil may be surrounded by a secondary annular coil. Heaters according to this aspect of the invention are thus adapted to define a single continuous large heating area, when both coils are energised, which provides substantially uniform transmission of heat to the entire "exposed area" of the top for larger utensils, or a smaller area for smaller utensils.

Where two or more heater elements are used, it is also preferable to separate the elements by one or more dividing walls to confine the transmitted heat to separate distinct heating zones on the top. In this way, undesirable spread of the heat transmitted from the element is minimized, bearing in mind that the top is normally substantially thermally non-conductive.

The use of one or more dividing walls is especially advantageous in substantially circular heaters. For example, a central circular element can define a heating area for small utensils and an annular element surrounding the central element can be used to extend the area for larger utensils. The provision of a dividing wall confines the smaller area to inhibit wastage. Of course, additional annular elements may be employed also. The material of the dividing wall is preferably a ceramic fibre insulation material (made from alumino silicate fibres) but other materials such as calcium silicate or MICROTHERM can be used.

In all heaters of the invention, a thermal cut out is preferably employed to avoid overheating. Where two or more elements are used, it may be located only over the larger or largest element but operable to switch off all elements simultaneously.

In a cooking appliance with a glass ceramic surface the cut out device serves to prevent the glass ceramic temperature from exceeding its safe operating temperature during all forms of normal cooking use and during abnormal use. While it is possible for a radiant heater to be designed so that a cut out is not needed by ascribing to the heater a rather low watts density, this leads to a slow cooking performance, but in some instances this may be acceptable as a means of avoiding the cost of the cut out device. It is generally preferred however, to use a thermal cut out to allow provision of better cooking performance. (Avoidance of extremely high temperatures—greater than 600° C. at the exposed glass surface—can also avoid some problems of staining of the glass ceramic.)

The electrical and thermal insulating material used in heaters of the invention is preferably that known as MICROTHERM and available from Micropore International Limited. This material can be formed with shallow grooves in which the element or elements sit. We have found that this arrangement assists in holding the element in position, preventing it from losing its shape, while having no undesirable effect on the efficiency of the heater. In some cases we have found the heating effect to be increased.

The or each heating element in heaters of the invention is preferably an open coil which is stapled or cemented, (for example by a ceramic fibre cement) onto the base. The shape of the coil should be as stable as possible for maximum life of the heater. The shape of a coil can be stabilised by forming it into the desired shape and heating it to its annealing temperature. Upon cooling, the desired shape will be retained. Such method is described in our copending U.S. Application Ser. No. 119,062 to which reference is directed.

BRIEF DESCRIPTION OF THE DRAWINGS

Two embodiments of the invention will now be described by way of example and with reference to the accompanying drawing wherein like numerals refer to like parts throughout and in which.

DESCRIPTION OF PREFERRED EMBODIMENTS

Figure 1:
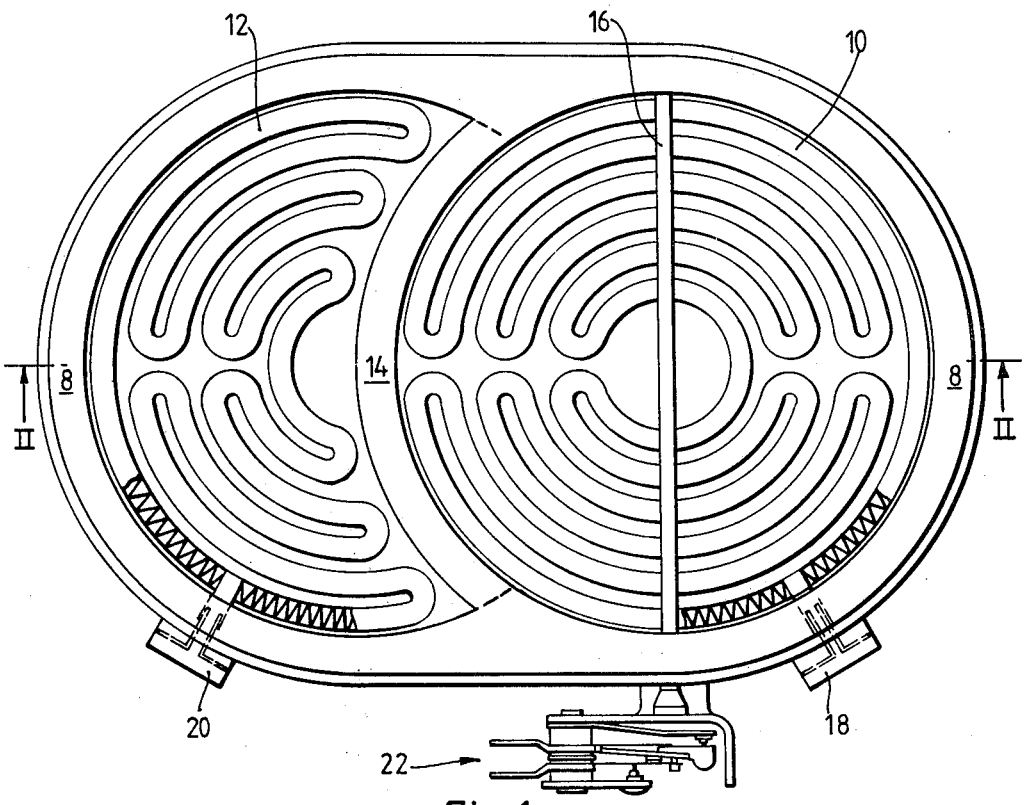
FIG. 1 is a plan view of a heater according to the invention.

The heater illustrated in the drawings comprises a metal dish 2 containing a base 4 of electrical and thermal insulating material. Against the side 6 of the dish is located a peripheral wall 8 of thermal insulation. Set in grooves formed in the base 4 are two electric heater coils 10 and 12 which are separated from each other by a dividing wall 14. Extending over the larger coil 10 is a thermal cut out 16 which is operable to switch off both coils in the event of overheating.

Each coil is controllable independently through terminal connectors 18 and 20 enabling a circular pan or utensil to be heated solely by the coil 10 and a larger possibly oval casserole or similar utensil be heated on both. Of course, a smaller pan might be heated on coil 12 alone. Typically, the coil 10 is a 1400 watt unit while the coil 12 is an 800 watt unit.

Each coil is unprotected and secured in the base 4 by means of staples (not shown). Each coil is preferably made from an iron chromium aluminium resistance heating wire and shaped by the method described in our copending Application referred to above.

The thermal cut out is of the differential expansion type and comprises a quartz tube containing a length of Inconel wire, differential expansion as a consequence of overheating operating a mechanical switch 22 to disconnect both coils 10 and 12 from the power source. Although a thermal cut out could be located adjacent each coil, we have found that one over the larger coil is quite satisfactory.

It will be appreciated that the principle of using two separated and independently operable heating coils in a radiant heater of the kind described herein can be extended to all shapes of heater. For example, a central coil surrounded by an annular coil as referred to above provides a heater having two different circular heating zones definable but the same principle may be applied to square or rectangular heaters. On a smooth top cooker however, where the top is substantially thermally non-conductive it is advantageous to provide a dividing wall of thermal insulating material such as 14 in FIG. 1, to define distinct and separate heating zones. Without a dividing wall, heat radiating from each coil would extend beyond the surface of the top immediately above it with consequent wastage of heat.

The lateral thickness of the dividing wall 14 should be thick enough to prevent substantial transmission of heat from the zone heated by coil 10 from that heated by coil 12, but thin enough so as not to create a "cold spot" or "line" between the zones when both coils are energised. We have found a thickness of 10–15 mm to be satisfactory in a heater of the kind illustrated herein. The height of the wall 14, in the optimum arrangement will be the same as that of the peripheral wall 8 so that in use, both the peripheral wall 8 and the dividing wall 14 engage the underside of the top 15 in the cooker. In practice though, this is difficult to achieve and the dividing wall 14 is designed 1 or 2 mm shorter to ensure that at least the peripheral wall 8 engages the top to inhibit the lateral dissipation of heat from the total heating area.

Figure 2:
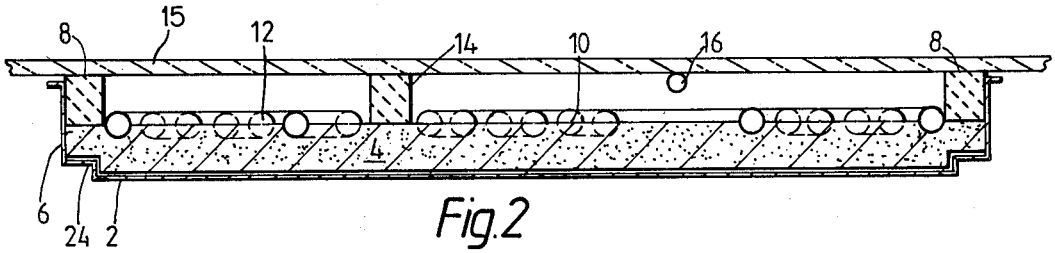
FIG. 2 is a section taken on line II—II of FIG. 1.
Figure 3:
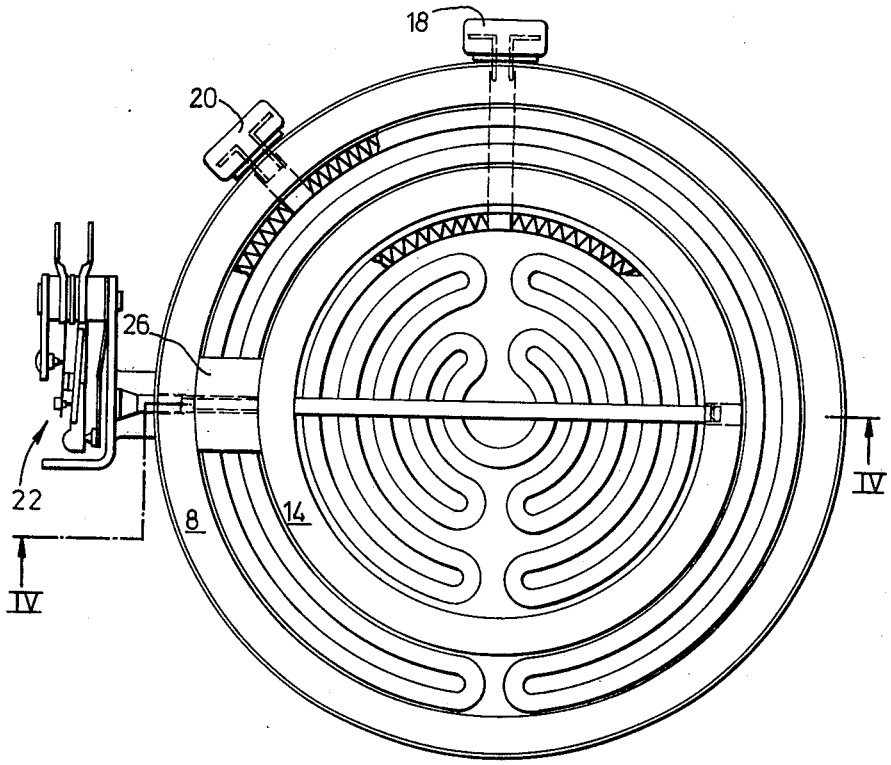
FIG. 3 is a plan view of a heater according to a second embodiment of the invention.
Figure 4:
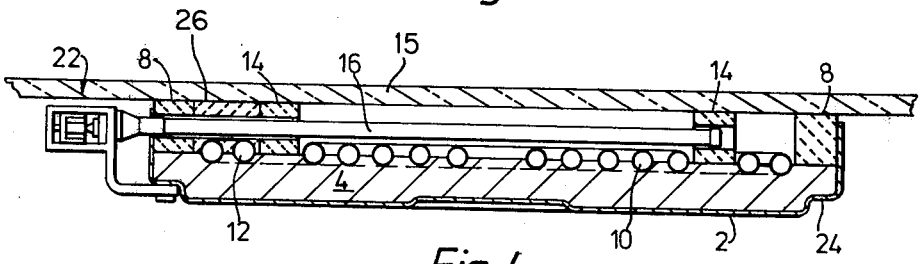
FIG. 4 is a section taken on line IV—IV of FIG. 3.

An embodiment of the invention comprising two concentric coils is illustrated in FIGS. 3 and 4. In this heater, the primary coil 10 is located in the centre with the secondary coil 12 encircling it. The dividing wall 14 is thus circular and divides the heating area defined by the peripheral wall 8 into a central and an annular zone. As with the embodiment of FIGS. 1 and 2, each coil 10,12 is operable independently through terminal connectors 18 and 20.

The circular embodiment of FIGS. 3 and 4 requires a different form of thermal cut out from that of FIGS. 1 and 2. For the same reasons, the cut out need only be located over the primary coil but to be reliably effective, it must be thermally isolated from the secondary coil 12. To achieve this the thermal cut out 16 is enclosed by a block 26 of thermal insulation where it extends over the secondary coil 12 between the peripheral wall 8 and the dividing wall 14. The thermal cut out 16 terminates in the dividing wall on the other side of the primary coil 10.

The heater illustrated in the drawings has a step junction 24 between the underneath and side of the dish 2 to facilitate mounting of the heater in a cooking appliance. The horizontal flange may be provided with screw holes for securing the heater.

I claim:

1. In an electric cooker having a continuous smooth top and at least one radiant heater located against the underside of the smooth top, the smooth top being transparent and substantially non-absorptive to radiant cooking heat, and at least one radiant heater comprising a metal dish having a base supporting a base layer of thermal insulating material and a sidewall against which a peripheral wall of thermal insulating material is mounted; and at least two heater elements supported on said base layer of thermal insulating material with a dividing wall of thermal insulating material therebetween, said dividing wall extending to a height substantially equal to the height of said peripheral wall, and both walls extending beyond the sidewall of the metal dish to the underside of said smooth top; wherein one of said elements is encircled by said dividing wall and a part of said peripheral wall to define with a first portion of the smooth top a first chamber, said first portion of the smooth top constituting a first heating zone effective over a predetermined first planar area of the smooth top upper surface, said one element being energisable independently to heat said first zone and said encircling wall preventing loss of radiant cooking heat outside of the encircled area; and wherein said other element is surrounded by a wall of thermal insulating material to define with a second portion of the smooth top a second chamber, said section portion of the smooth top constituting a second heating zone effective over a predetermined second planar area of the smooth top upper surface adjacent to and contiguous with said first area, said surrounding wall comprising said dividing wall and a part of said peripheral wall and said two heater elements being energisable together to heat both zones and generate heat over an elongated planar area bounded by said peripheral wall.

2. A radiant heater according to claim 1 which is non-circular.

3. A radiant heater according to claim 2 wherein said one heater element is circular.

4. A radiant heater according to claim 2 wherein said one heater element is circular and said other heater element is part circular.

5. A heater according to claim 4 wherein the enlarged planar area bounded by said peripheral wall is oval.

6. A radiant heater according to claim 2 including a thermal cut out device extending over said circular element and arranged to deenergize both of said elements at a preselected temperature.

7. In an electric cooker having a continuous smooth top and at least one radiant heater located against the underside of the smooth top, the smooth top being transparent and substantially non-absorptive to radiant cooking heat, said at least one radiant heater comprising a metal dish having a base supporting a base layer of thermal insulating material and a sidewall against which a peripheral wall of thermal insulating material is mounted; and at least two heater elements supported on said base layer of thermal insulating material with a dividing wall of thermal insulating material therebetween, said dividing wall extending to a height substantially equal to the height of said peripheral wall, and both walls extending beyond the sidewall of the metal dish to the underside of said smooth top; wherein one of said elements is encircled by said dividing wall of thermal insulating material to define with a first portion of the smooth top a first chamber, said first portion of the smooth top constituting a first heating zone effective over a predetermined planar area of the smooth top upper surface, said one element being energisable independently to heat said first zone and said dividing wall preventing loss of radiant cooking heat outside of the encircled area; and wherein said other element surrounds said one element and defines with a second portion of the smooth top a second chamber, said second portion of the smooth top constituting a second heating zone effective over a predetermined annular area of the smooth top upper surface around said planar area, and said two heater elements are energisable together to heat both zones and generate heat over an enlarged planar area bounded by said peripheral wall.

8. A radiant heater according to claim 7 which is substantially circular and includes a central element and one or more annular elements surrounding said central element.

9. A radiant heater according to claim 1 or claim 7 wherein each element is energizable independently.

10. A radiant heater according to claim 1 or 7 wherein each element is an unprotected coil.

11. A radiant heater according to claim 10 wherein the coils are held in grooves formed in said base layer.

12. A radiant heater according to claim 7 including a thermal cut out device extending over said one heater element and over at least a part of said other heater element, said device being arranged to deenergize all of said heater elements at a preselected temperature and being thermally shielded from said other element where it extends thereover.

13. In an electric cooker having a continuous smooth top and at least one radiant heater located against the underside of the smooth top, the smooth top being transparent and substantially non-absorptive to radiant cooking heat, said at least one radiant heater comprising:

a metal dish having a base supporting a base layer of thermal insulating material and a sidewall;

at least two radiant heating elements supported on said base layer and energisable to provide radiant cooking heat thereabove;

a peripheral wall of thermal insulating material extending upward from said base layer to a height greater than the height of said dish sidewall and surrounding said heating elements to define with a region of the smooth top a chamber, said region of the smooth top constituting a composite radiant heating zone effective over a predetermined planar area of the smooth top upper surface substantially equal to the area bounded by said peripheral wall; and, a dividing wall of thermal insulating material extending upward from said base layer to a height substantially equal to the height of said peripheral wall and cooperating with said peripheral wall and with the smooth top to define first and second radiant heating zones effective over predetermined separate planar areas of the smooth top upper surface adjacent and contiguous to each other within said composite planar area, said dividing wall passing between at least two of said heating elements and at least one of said heating elements being encircled by said dividing wall or said dividing wall and a portion of said peripheral wall;

said at least one of said heating elements being energisable independently of another of said heating elements and positioned to expose said first heating zone to radiant cooking heat, said encircling wall preventing loss of radiant cooking heat outside of the encircled area and said heating elements being energisable together and positioned to expose said composite heating zone to radiant cooking heat.

* * * * *

UNITED STATES PATENT AND TRADEMARK OFFICE

CERTIFICATE OF CORRECTION

PATENT NO. : 4,327,280

DATED : April 27, 1982

INVENTOR(S) : Joseph A. McWilliams

It is certified that error appears in the above—identified patent and that said Letters Patent is hereby corrected as shown below:

On the cover sheet, after the line that reads "[22] Filed: Feb. 6, 1980", insert as the next line --[30] Foreign Application Priority Data Feb. 7, 1979 [GB] United Kingdom ..... 7904289--.

Signed and Sealed this

*Twenty-first* Day of *December 1982*

[SEAL]

*Attest:*

GERALD J. MOSSINGHOFF

*Attesting Officer*

*Commissioner of Patents and Trademarks*